US005810627A

United States Patent [19]

Gierut et al.

[11] Patent Number: 5,810,627

[45] Date of Patent: Sep. 22, 1998

[54] FEMALE ELECTRICAL TERMINAL

[75] Inventors: Frederick J. Gierut, Tinley Park; Stephen A. Colleran, Lisle; Russell L. Mackowiak, Wheaton; Paul Christopher Berg, Batavia; Harry N. Etters, Plainfield; John O. Higgins, Jr., Berwyn, all of Ill.; Theo Poll, Reichschoffen, France; Alexander Popa, Karlsgad, Germany; Kevin C. Benes, Willowbrook, Ill.; Frank L. Geoghegan, Hinsdale, Ill.; David Richard Kalal, Wheaton, Ill.; Scott P. Marceau, Plainfield, Ill.; Robert Olson, Schaumburg, Ill.

[73] Assignee: Molex Incorporated, Lisle, Ill.

[21] Appl. No.: 726,254

[22] Filed: Oct. 4, 1996

Related U.S. Application Data

[63] Continuation-in-part of Ser. No. 583,833, Jan. 11, 1996.

[51] Int. Cl.[6] ..... H01R 15/10

[52] U.S. Cl. ..... 439/843

[58] Field of Search ..... 439/842–853

[56] References Cited

U.S. PATENT DOCUMENTS

| | | | |
|---|---|---|---|
| 5,186,664 | 2/1993 | Abe | 439/845 |
| 5,217,382 | 6/1993 | Sparks | 439/843 |
| 5,226,842 | 7/1993 | Endo et al. | 439/843 |
| 5,271,741 | 12/1993 | Saito et al. | 439/843 |
| 5,433,629 | 7/1995 | Yagi et al. | 439/843 |
| 5,441,428 | 8/1995 | Hamai et al. | 439/843 |

FOREIGN PATENT DOCUMENTS

| | | | |
|---|---|---|---|
| 2707431 | 1/1995 | France | 439/843 |
| 07050178-A | 2/1995 | Japan | H01R 13/15 |

*Primary Examiner*—Gary F. Paumen
*Assistant Examiner*—Brian J. Biggi
*Attorney, Agent, or Firm*—A. A. Tirva

[57] ABSTRACT

A female electrical terminal has a contact end and a terminating end. The contact end includes a pair of opposing walls for receiving a male terminal therebetween. A flexible element is disposed in the contact end for pressing against the male terminal. The flexible element includes a mounting section with spaced wall portions juxtaposed inside the opposing walls of the contact end. Complementary interengaging latches are provided between the opposing walls and the spaced wall portions of the mounting section of the flexible element. An abutment is provided in the contact end to prevent inward collapsing of the spaced wall portions and, thereby, to maintain the latches in interengagement.

12 Claims, 6 Drawing Sheets

FEMALE ELECTRICAL TERMINAL

RELATED APPLICATION

This is a continuation-in-part of co-pending application Ser. No. 08/583,833, filed Jan. 11, 1996 and assigned to the assignee of the present application.

FIELD OF THE INVENTION

This invention generally relates to the art of electrical connectors and, particularly, to a female terminal for use in an electrical connection.

BACKGROUND OF THE INVENTION

Very generally, a typical electrical connector combination includes a plug connector and a receptacle connector, both of which mount or house interengageable electrical terminals. The plug connector is inserted into or mated with the receptacle connector to interengage the terminals. The terminals may take a variety of configurations, including male and female or pin and socket terminals.

A known type of female socket terminal is elongated and has a terminating end and a contact end. The terminating end may be adapted for termination to an electrical wire, for instance. The contact end is box-shaped or generally rectangular in cross-section for receiving a male or pin contact or terminal. The female socket terminal typically is stamped and formed from sheet metal material, and spring sections may be stamped therefrom for resiliently gripping the pin contact or terminal. On the other hand, separate spring contact elements have been used with such female socket terminals.

For example, in U.S. Pat. No. 5,441,428, dated Aug. 15, 1995, a female socket terminal employs a separate spring element to resiliently grip an inserted pin contact or terminal. In particular, the female socket terminal disclosed therein is generally rectangular in cross-section and includes a bottom plate portion having two sides. A pair of opposing side plate portions extend upwardly from both sides of the bottom plate portion. Two lug engagement holes are formed in the two side plate portions immediately adjacent the bottom plate portion. A pair of opposing top plate half portions extend inwardly from upper ends of the side plate portions. A spring element is mounted within the female terminal and includes a spring body and a pair of lug portions engaged within the lug engagement holes formed in the two side plates portions near the bottom plate portion. During assembly, the top plate half portions and the side plate portions are spread apart to allow insertion of the spring element transverse to the longitudinal direction of the terminal until the lug portions of the spring element engage within the lug engagement holes formed in the two side plate portions near the bottom wall.

Problems are encountered with female socket terminals as described above in relation to the U.S. Pat. No. 5,441,428 patent and other female socket terminals using lug portions on the spring element engageable within lug engagement holes in the contact end of the terminal. In particular, such lug systems have difficulties in maintaining the stability of the spring contact element. In addition, problems are encountered by the difficulty or complexity of the assembly processes required for engaging the lug portions of the spring contact element within the contact end of the terminal.

The present is directed to solving the above problems and providing a box-type female socket terminal which is more reliable, provides greater stability for the spring contact element and is easier to manufacture than the prior art.

SUMMARY OF THE INVENTION

An object, therefore, of the invention is to provide a new and improved female electrical terminal of the character described.

In the exemplary embodiment of the invention, the female electrical terminal is elongated and includes a contact end and a terminating end. The contact end is generally rectangular in cross-section and is adapted to receive a male terminal or pin contact. The contact end includes a bottom wall, a pair of opposed side walls extending upwardly from opposite sides of the bottom wall and a top wall. A spring contact element is located in the contact end inside the top wall and adapted to bias the male contact or terminal into engagement with the bottom wall. The spring contact element includes a generally rectangular mounting section with side wall portions juxtaposed inside the opposing side walls at the contact end of the terminal. Complementary interengaging latch means are provided between the opposing side walls and the side wall portions of the mounting section of the spring contact element.

In one embodiment of the invention, abutment means are provided on the bottom wall to prevent inward collapsing of the side wall portions and, thereby, to maintain the latch means in interengagement. As disclosed herein, the bottom wall includes a raised boss adapted for engaging the male terminal. The raised boss comprises the abutment means for preventing inward collapsing of the side wall portions of the mounting section of the spring contact element. The raised boss is formed by a raised rib extending longitudinally of the terminal. The spring contact element is formed by a cantilevered contact blade extending longitudinally of the terminal. In another embodiment, the abutment means is eliminated, and the terminal is fabricated of spring metal so that it does not collapse.

In one embodiment of the invention, the complementary interengaging latch means is provided by latch projections on the side wall portions of the mounting section of the spring contact element, and the latch projections engage within openings in the side walls of the contact end of the terminal. In another embodiment of the invention, the latch projections are provided on the side walls of the contact end of the terminal for engagement within openings in the side wall portions of the mounting section of the spring contact element.

Lastly, in one embodiment stop means are provided on the side walls engageable with the side wall portions of the mounting section of the spring contact element to define a forward limit position of the spring contact element in the contact end of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
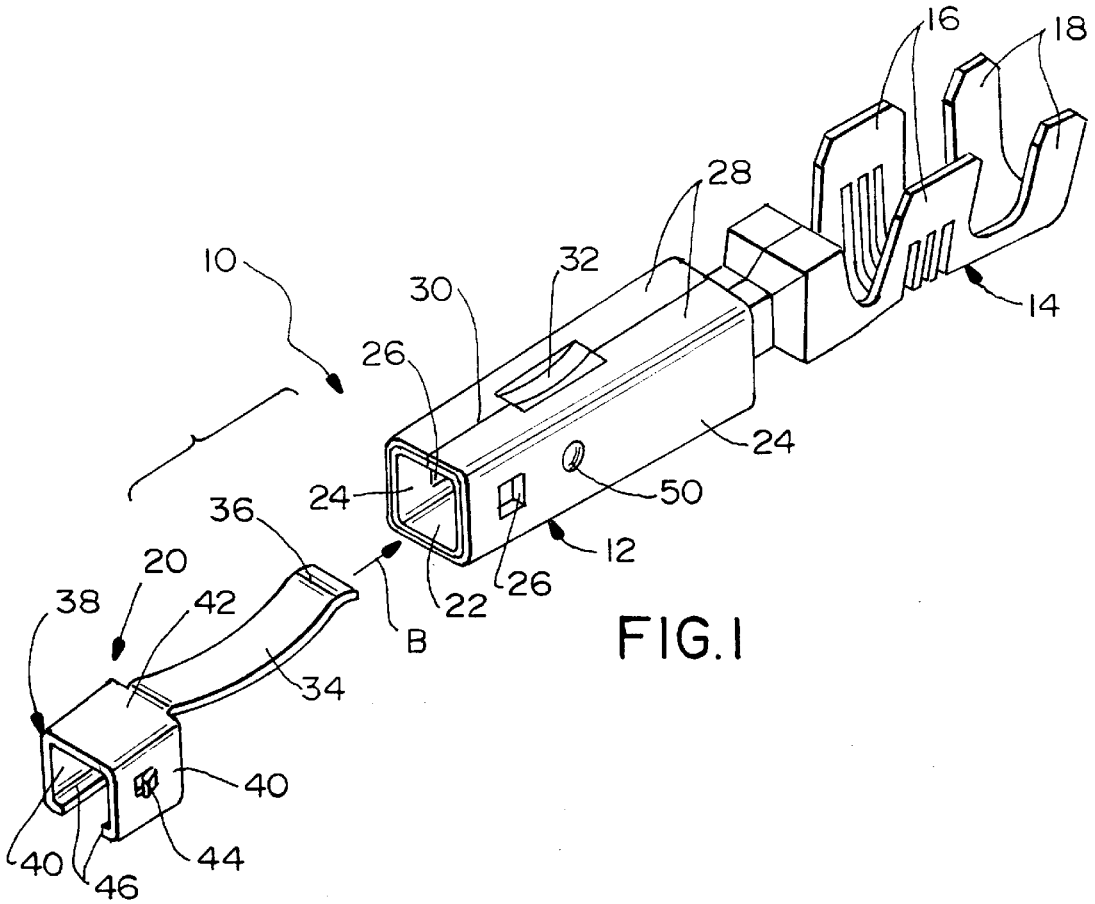
FIG. 1 is an exploded perspective view of one embodiment female electrical terminal according to the invention, with the spring contact element about to be inserted axially into the contact end of the terminal.
Figure 2:
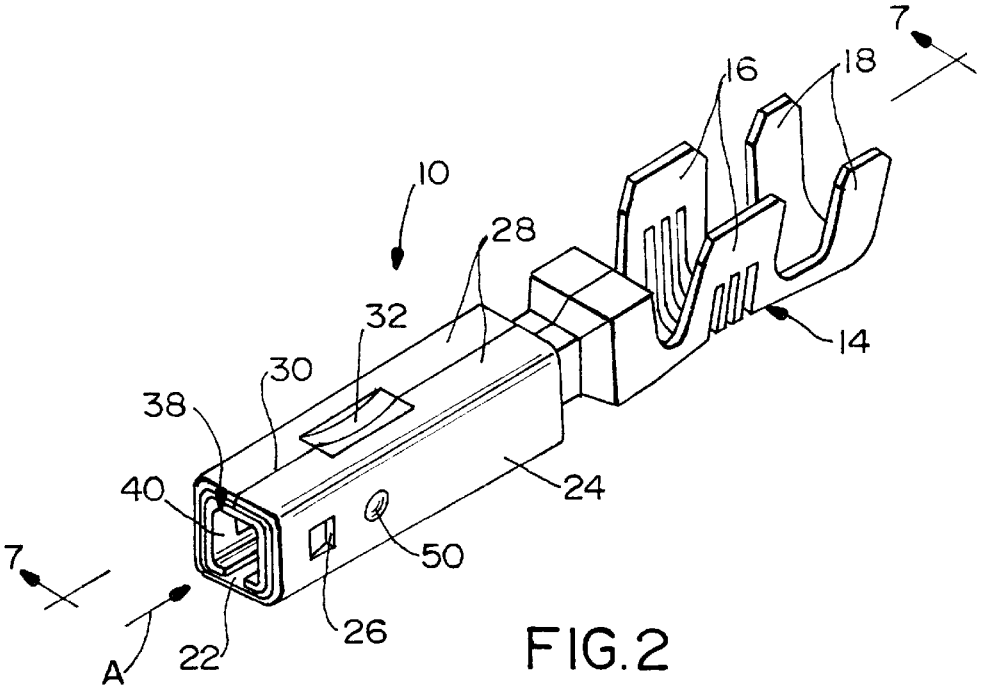
FIG. 2 is a perspective view of the female electrical terminal of FIG. 1, with the spring contact element fully inserted into its proper position.

Referring to the drawings in greater detail, and first to FIGS. 1 and 2, one embodiment of the invention is shown in an elongated female electrical terminal, generally designated 10, which includes a contact end, generally designated 12, and a terminating end, generally designated 14. Terminating end 14 includes two pairs of crimp arms 16 and 18 for clamping onto an electrical wire. Contact end 12 is generally box-shaped or rectangular in cross-section and mounts a spring contact element, generally designated 20, for resiliently gripping a pin contact or male terminal inserted into the contact end of the female electrical terminal in the direction of arrow "A" (FIG. 2). The spring contact element is inserted into contact end 12 in the direction of arrow "B" (FIG. 1).

More particularly, contact end 12 includes a bottom wall 22 and a pair of opposing side walls 24 extending upwardly from opposite sides of the bottom wall. A latch opening 26 is formed in each side wall 24. A pair of opposing top wall half portions 28 extend inwardly from upper ends of side walls 24 and are joined at a seam 30 due to the fact that the terminal is stamped and formed of sheet metal material. Lastly, an inwardly concave detent 32 is formed in top half wall portions 28 spanning seam 30. The detent provides an anti-overstress means for the contact blade of the spring contact element described hereinafter. The entire elongated structure including contact end 12 and terminating end 14 is stamped and formed from conductive sheet metal material.

As best in FIG. 1, spring contact element 20 includes a cantilevered, inwardly bowed contact blade 34 terminating in a rounded distal end 36. A generally rectangular, box-shaped mounting section, generally designated 38, is formed at the end of contact blade 34 opposite distal end 36. The mounting section includes side wall portions 40 joined by a top wall portion 42. A latch projection or boss 44 extends outwardly from each side wall portion 40. A flange or lip 46 extends inwardly along the bottom edge of each side wall portion 40.

Spring contact element 20 is inserted into contact end 12 in the direction of arrow "B" as shown in FIG. 1, until the entire spring contact element is located within the contact end as shown in FIG. 2. In essence, generally rectangular mounting section 38 of the spring contact element nests within the generally rectangular contact end 12, and the male terminal actually is inserted directly into the mounting section of the spring contact element. When fully inserted, rounded distal end 36 of the spring contact element engages the inside of top wall half portions 28, and inwardly bowed contact blade 34 engages the top of the male terminal, all of which will be seen more clearly hereinafter. The entire spring contact element 20, including mounting section 38, is stamped and formed from conductive sheet metal material.

Figure 4:
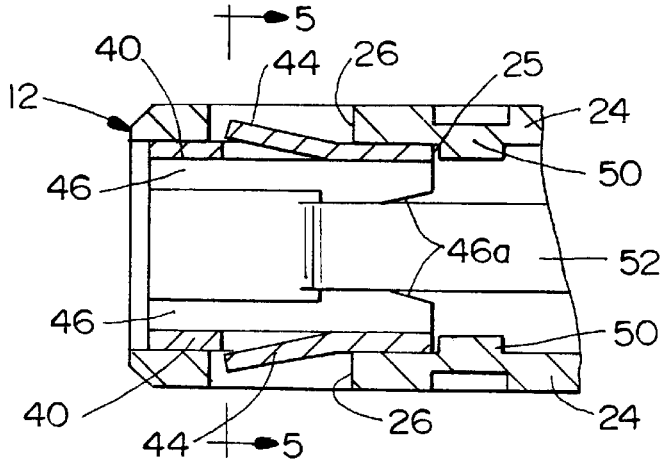
FIG. 4 is a vertical section taken generally along line 4—4 of FIG. 3.
Figure 3:
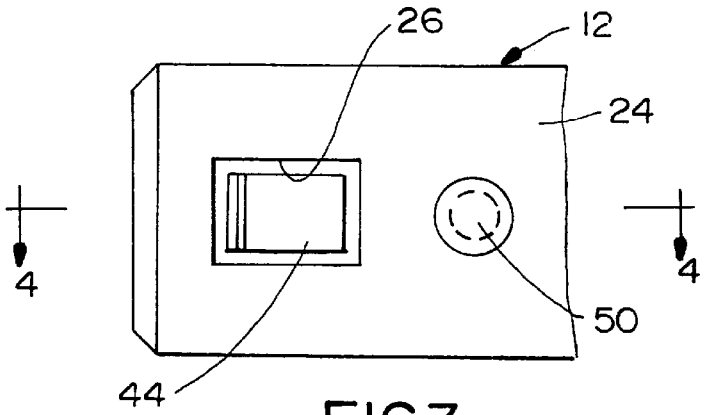
FIG. 3 is a fragmented side elevational view of the extreme left-hand end of the terminal as viewed in FIGS. 1 and 2.

FIGS. 3 and 4 best show how latch projections 44 project outwardly from side wall portions 40 of mounting section 38 of the spring contact element and into openings 26 in side walls 24 of contact end 12 of the terminal. There is more "play" or spacing around the projections within the openings in the drawings than in actual practice, so as to facilitate the illustration. FIGS. 3 and 4 also show a feature wherein a pair of inwardly stamped detents 50 are formed in side walls 24 of contact end 12 for engagement by the front edges of side wall portions 40 of the mounting section of the spring contact element. Detents 50 provide stop means on side walls 24 to define a forward limit position of spring contact element 20 within contact end 12 of the terminal. In the opposite direction, free tip ends of latch projections 44 engage the rear edges of openings 26 to prevent the spring contact element from moving back rearwardly of the terminal out of the contact end thereof.

Figure 5:
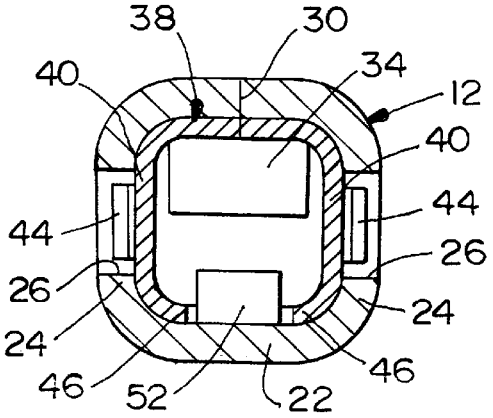
FIG. 5 is a vertical section taken generally along line 5—5 of FIG. 4.

Generally, the invention contemplates the provision of abutment means on contact end 12 to prevent inward collapsing of side wall portions 40 of mounting section 38 of spring contact element 20 and, thereby, to maintain latch projections 44 within openings 26. More particularly, referring to FIG. 5 in conjunction with FIG. 4, a raised boss 52 is formed out of bottom wall 22 of contact end 12 of the terminal. The raised boss extends upwardly between the edges of inwardly directed flanges 46 at the bottom of side wall portions 40 of mounting section 38 of the spring contact element. Raised boss 52 prevents the side walls from collapsing inwardly and, thereby, prevents latch projections 44 from moving inwardly out of latching interengagement within openings 26 in side walls 24 at the contact end of the terminal. Actually, the boss engages chamfered inner ends **46*a* (FIG. 4) of flanges 46 at the bottom edges of side wall portions 40**. The chamfered inner ends facilitate inserting the spring contact element into the contact end of the terminal.

Figure 6:
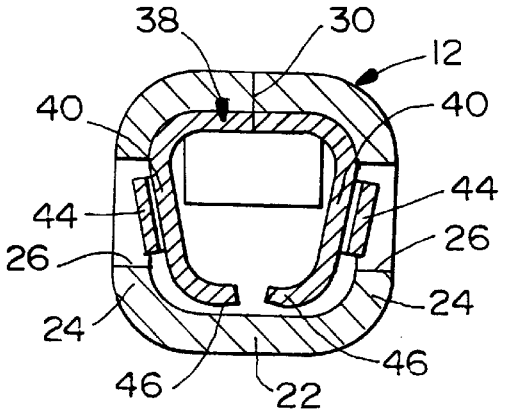
FIG. 6 is a view similar to that of FIG. 5, but showing an undesirable structure wherein the side wall portions of the spring contact element have been collapsed inwardly.

FIG. 6 shows an undesirable structure wherein raised boss 52 (FIG. 5) has been eliminated which, in effect, allows side wall portions 40 of the mounting section 38 of the spring contact element to collapse inwardly. It can be seen that latch projections 44 have moved inwardly and practically out of latching engagement within openings 26 in side walls 24 at the contact end of the terminal. The spring contact element could easily be pulled back out of the contact end of the terminal under such conditions. Referring back to FIG. 5, it readily can be understood how raised boss 52 prevents the undesirable condition shown in FIG. 6 from occurring.

Figure 7:
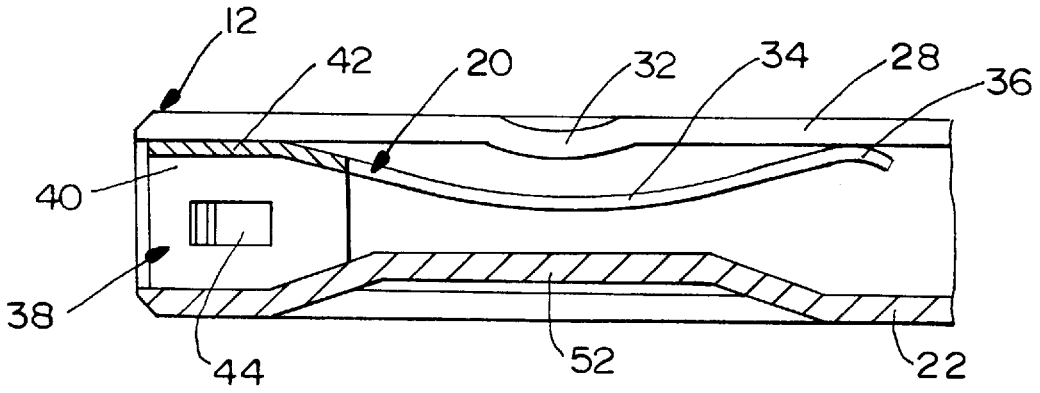
FIG. 7 is an axial section taken generally along line 7—7 of FIG. 2.

FIG. 7 shows that raised boss 52 actually is formed as a raised rib extending longitudinally of the terminal. FIG. 7 also shows how rounded distal end 36 of inwardly bowed contact blade 34 engages the inside of top wall half portions 28 at contact end 12 of the terminal.

Figure 8:
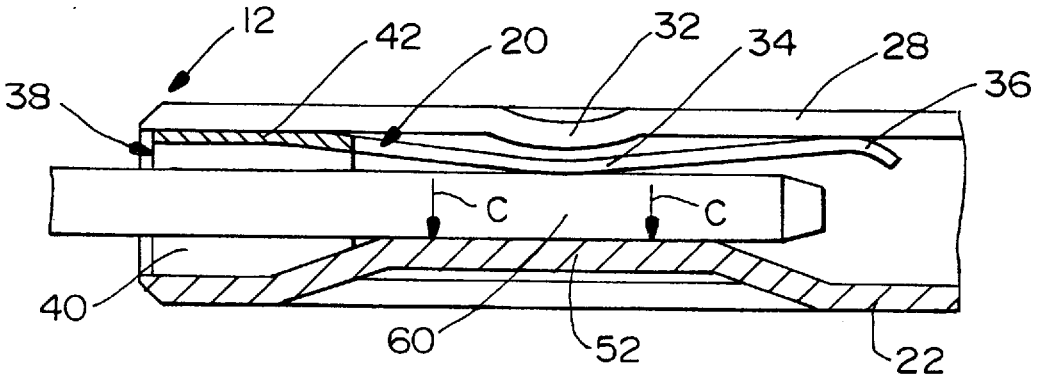
FIG. 8 is an axial section similar to that of FIG. 7, but with a male terminal inserted into the female terminal.

Finally, FIG. 8 shows a male terminal 60 inserted into contact end 12 within mounting section 38 of spring contact element 20 and into engagement with cantilevered contact blade 34 of the spring contact element. It can be seen that the contact blade has been compressed, whereby the contact blade essentially biases male terminal 60 downwardly in the direction of arrows "C" into positive engagement with raised rib 52 about bottom wall 22. Thus, the raised rib performs a dual function of providing a more positive engagement with the male terminal than if the male terminal had to engage the massive flat bottom wall of the terminal, as well as providing the aforesaid abutment means to prevent inward collapsing of the side wall portions of the mounting section of the spring contact element.

FIGS. 9–15 show a second embodiment of the invention wherein an elongated female electrical terminal, generally designated 10A, includes a contact end, generally designated 12A, for receiving and mounting a spring contact element, generally designated 20A. Connector 10A in FIGS. 9–15 is similar to connector 10 in FIGS. 1–8 and, therefore, like numerals have been applied to like components of contact end 12 and spring contact element 20 in FIGS. 9–15 corresponding to the same components in FIGS. 1–8. For simplicity and brevity purposes, the description of those like components and their functions will not be repeated. It immediately can be seen that spring contact element 20A is mounted into contact end 12A transversely of the terminal as shown by arrow "B" in FIG. 9, contrary to the axial insertion of spring contact element 20 in the direction of arrow "A" in FIG. 1.

Figure 9:
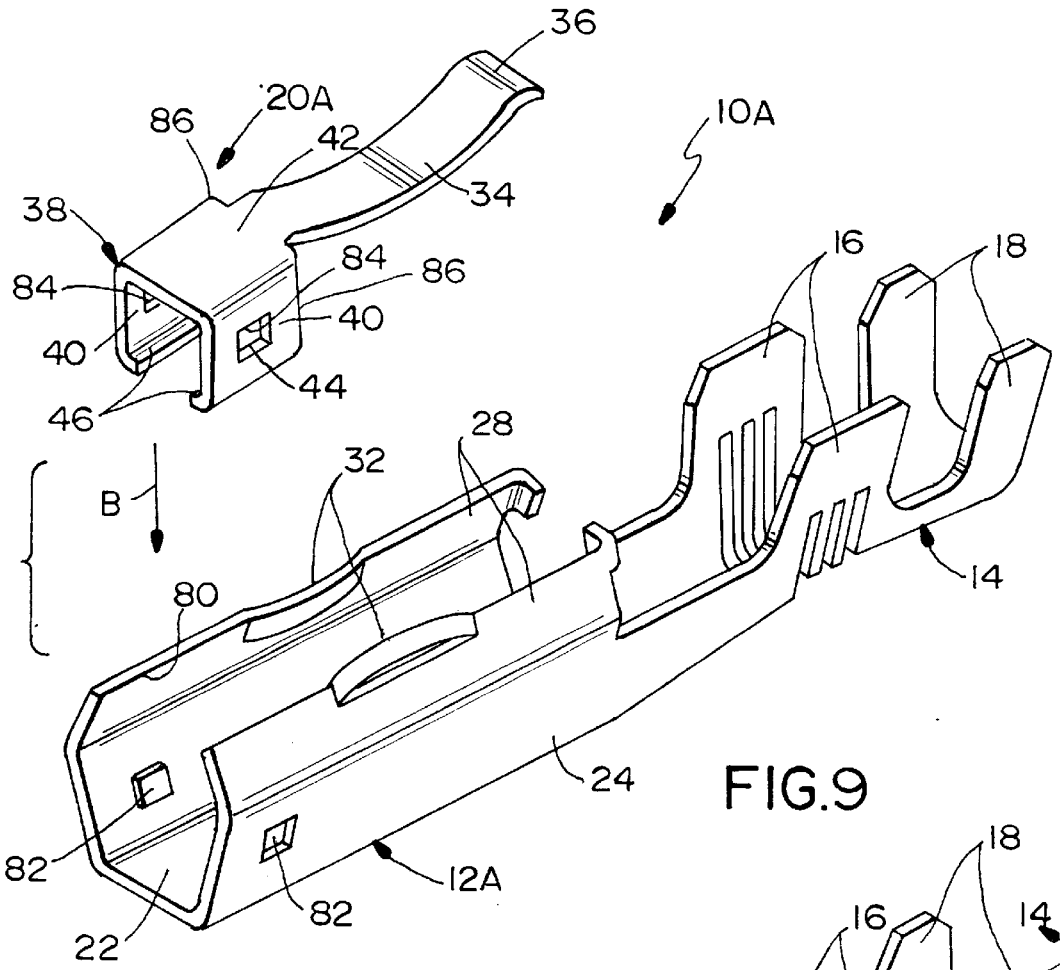
FIG. 9 is an exploded perspective view of another embodiment of a female electrical terminal according to the invention, with the spring contact element about to be inserted transversely into the contact end of the terminal.
Figure 10:
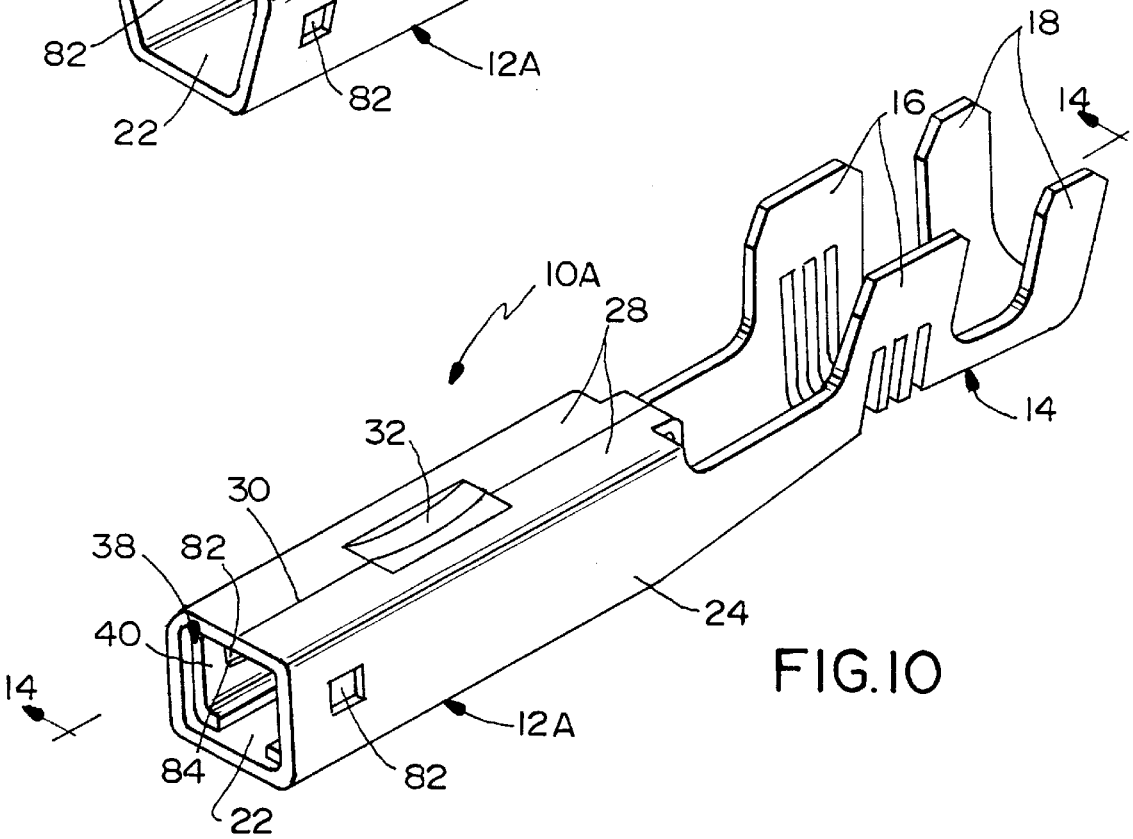
FIG. 10 is a perspective view of the female electrical terminal of FIG. 9, with the spring contact element fully inserted into its proper position.
Figure 12:
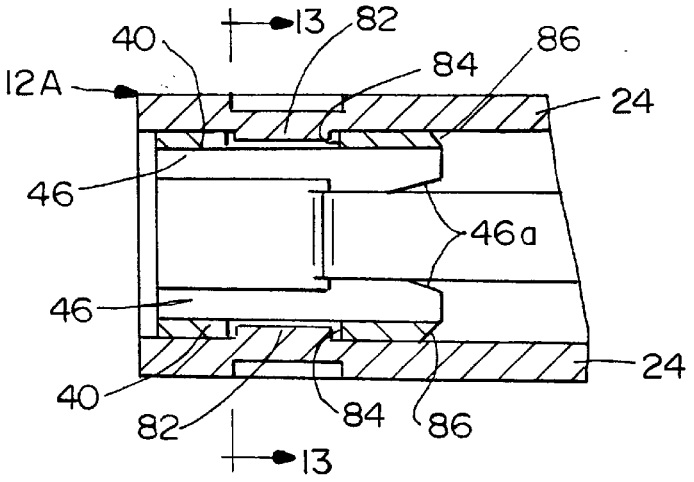
FIG. 12 is a vertical section taken generally along line 12—12 of FIG. 11.
Figure 13:
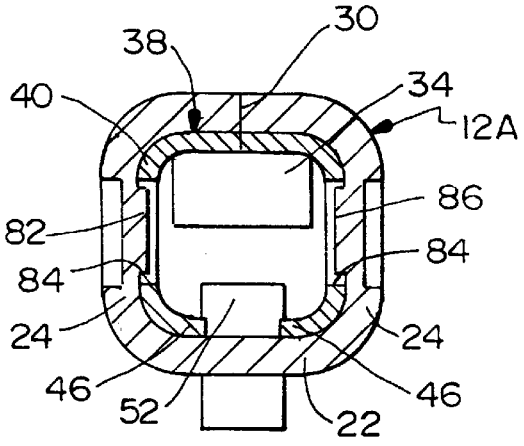
FIG. 13 is a vertical section taken generally along line 13—13 of FIG. 12.
Figure 11:
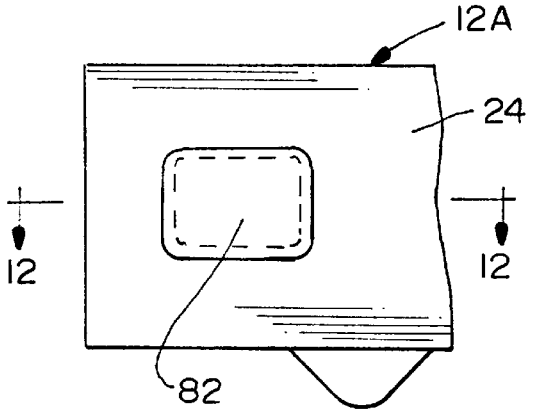
FIG. 11 is a fragmented side elevational view of the extreme left-hand end of the terminal as viewed in FIGS. 9 and 10.

More particularly, FIG. 9 shows that contact end 12A of the second embodiment of the invention initially is in an "open" condition, with side walls 24 bent outwardly and top half wall portions 28 spread apart to define an opening 80 therebetween. The opening is wide enough for spring contact element 20A to be inserted downwardly therethrough in the direction of arrow "B". When the rectangular, box-shaped mounting section 38 of spring contact element 20A seats onto bottom wall 22 of contact end 12A, side walls 24 of the contact end are closed inwardly, along with closing top half wall portions 28 at seam 30 to capture the spring contact element within the contact end of terminal 10A.

It should be noted that a latch projection or boss 82 extends inwardly from each side wall 24 of contact end 12A for insertion into a latch opening 84 in the adjacent side wall portion 40 of spring contact element 20A. This is a reverse configuration in comparison to the embodiment of FIGS. 1–8 wherein latch projections 44 extend outwardly from the spring contact element into latch openings in the side walls of the contact end. By providing openings 84 in side wall portions 40 of spring contact element 20A in the second embodiment of FIGS. 9–15, side walls 24 and top half wall portions 28 do not have to be spread apart excessively for spring contact 20A to be inserted transversely into contact end 12A in the direction of arrow "B".

It should be understood that spring contact end 20A of the second embodiment could be inserted axially into contact end 12A with the contact end being fully closed as in the first embodiment of FIGS. 1 and 2. To that end, the inner edges of side wall portions 40 of spring contact element 20A are chamfered, as at 86 (FIG. 9), to facilitate the side wall portions riding over the inwardly extending latch projections 82 on the inside of side walls 24 of contact end 12A.

Another difference in the second embodiment of electrical connector 10A in FIGS. 9–15 is that the abutment means provided by raised boss 52 (FIG. 5) has been eliminated in the second embodiment. More particularly, spring contact element 20A of the second embodiment is fabricated of a spring metal material, such as beryllium copper, which will cause side wall portions 40 of spring contact element 20A to retain their original configurations as shown in FIG. 9 regardless of whether the spring contact element is inserted transversely or axially into the contact end of the terminal and regardless of whether the side wall portions are moved inwardly toward each other during assembly. The beryllium copper material will cause the side wall portions to spring back outwardly toward their original dispositions.

Figure 14:
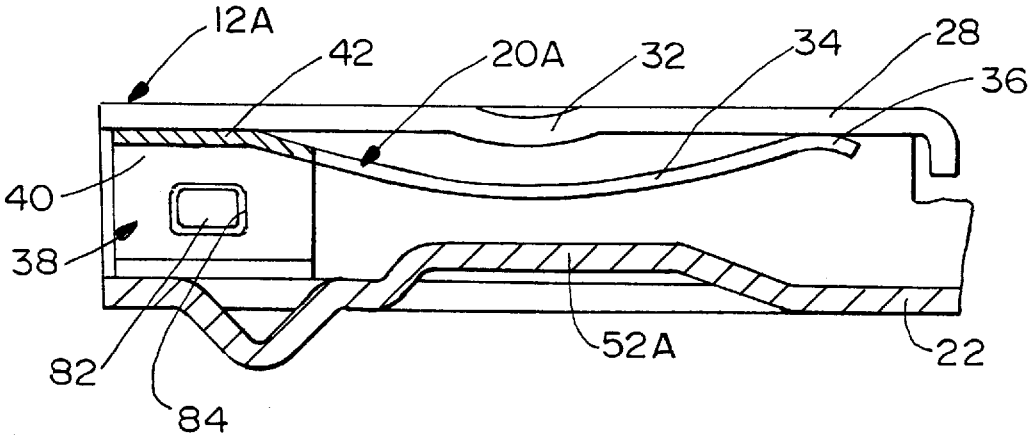
FIG. 14 is an axial section taken generally along line 14—14 of FIG. 10.
Figure 15:
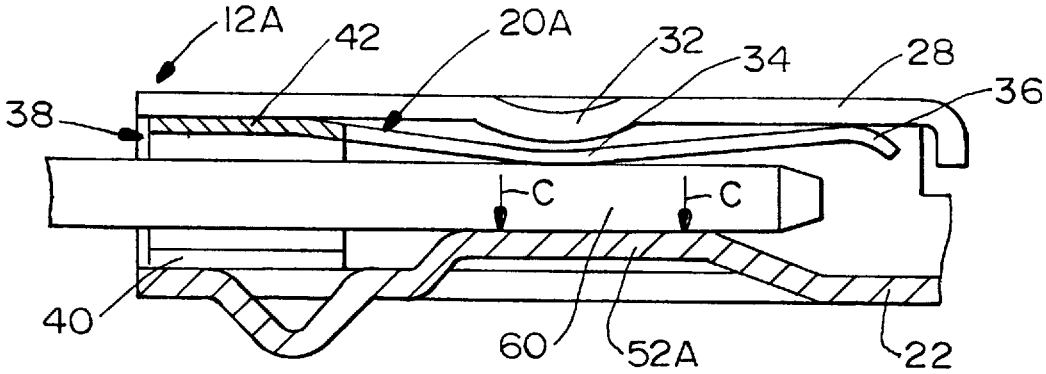
FIG. 15 is an axial section similar to that of FIG. 14, but with a male terminal inserted into the female terminal.

The second embodiment still has a raised boss in the form of a raised rib 52A for engaging the underside of male terminal 60 as shown in FIG. 15. However, the raised rib does not extend toward the distal end of contact end 12A between side wall portions 40 of spring contact element 20A, as can be seen in FIG. 14.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an elongated female electrical terminal which includes a contact end and a terminating end, the contact end being generally rectangular in cross-section and comprising:

a bottom wall, a pair of opposing and substantially equal side walls extending upwardly from opposite sides of the bottom wall, a top wall, a spring contact element located in the contact end inside the top wall and adapted to bias a male terminal into engagement with the bottom wall, said spring contact element including a generally rectangular mounting section including a top wall portion, a pair of opposing side wall portions extending downwardly from opposite sides of the top wall portion, and a pair of bottom wall portions each extending from its respective side wall portion towards the opposite side wall portion, said top wall, side wall and bottom wall portions in contact with top, side and bottom walls of the contact end, respectively, with said side wall portions juxtaposed inside said opposing side walls, complementary interengaging latch means between said opposing side walls and the side wall portions of the mounting section of the spring contact element, and abutment means on the bottom wall to prevent inward collapsing of said side wall portions and, thereby, to maintain said latch means in interengagement.

2. In an elongated female electrical terminal as set forth in claim 1, wherein said bottom wall includes a raised boss adapted for engaging the male terminal.

3. In an elongated female electrical terminal as set forth in claim 2, wherein said raised boss comprises said abutment means.

4. In an elongated female electrical terminal as set forth in claim 3, wherein said raised boss comprises a raised rib extending longitudinally of the terminal.

5. In an elongated female electrical terminal as set forth in claim 1, wherein said complementary interengaging latch means comprise latch projections on one of the side walls and side wall portions and openings in the other of the side walls and side wall portions.

6. In an elongated female electrical terminal as set forth in claim 1, including stop means on said side walls engageable with the side wall portions of the mounting section of the spring contact element to define a forward limit position of the spring contact element in the contact end of the terminal.

7. In an elongated female electrical terminal as set forth in claim 1, wherein said spring contact element includes a cantilevered contact blade extending longitudinally of the terminal.

8. In a female electrical terminal which includes a contact end and a terminating end, the contact end being generally rectangular in cross-section and comprising:

a bottom wall, a pair of opposing and substantially equal side walls extending upwardly from opposite sides of the bottom wall, a top wall including a pair of sections, each section extending from its respective side wall towards the opposite side wall, said top wall substantially equal and parallel to said bottom wall, a spring contact element located in the contact end inside the top wall and adapted to bias a male terminal into engagement with the bottom wall, said spring contact element including a generally rectangular mounting section including a top wall portion, a pair of opposing side wall portions extending downwardly from opposite sides of the top wall portion, and a pair of bottom wall portions each extending from its respective side wall portion towards the opposite side wall portion, said top wall, side wall and bottom wall portions in contact with top, side and bottom walls with said side wall portions juxtaposed inside said opposing side walls, and complementary interengaging latch means between said opposing side walls and the side wall portions of the mounting section of the spring contact element.

9. In a female electrical terminal as set forth in claim 8, wherein said complementary interengaging latch means comprise planar latch projections on said side walls and openings in said side wall portions to accommodate said latch projections.

10. In a female electrical terminal as set forth in claim 8, wherein said bottom wall includes a raised boss adapted for engaging the male terminal.

11. In a female electrical terminal as set forth in claim 10, wherein said raised boss comprises a raised rib extending longitudinally of the terminal.

12. In an elongated female electrical terminal which includes a contact end and a terminating end, the contact end being generally rectangular in cross-section and comprising:

a bottom wall including a raised rib extending longitudinally of the terminal, a pair of opposing and substantially equal side walls extending upwardly from opposite sides of the bottom wall, a top wall including a pair of sections, each section extending from its respective side wall towards the opposite side wall, said top wall substantially equal and parallel to said bottom wall, a spring contact element located in the contact end and including a cantilevered contact blade extending toward the terminating end to bias a male terminal into engagement with the raised rib of the bottom wall, said spring contact element including a generally rectangular mounting section including a top wall portion, a pair of opposing side wall portions extending downwardly from opposite sides of the top wall portion, and a pair of bottom wall portions each extending from its respective side wall portion towards the opposite side wall portion, said top wall, side wall and bottom wall portions in contact with top, side and bottom walls with said side wall portions juxtaposed inside said opposing side walls, and complementary interengaging latch means between said opposing side walls and the side wall portions of the mounting section of the spring contact element, the complementary interengaging latch means comprising planar latch projections on said side wall extending inwardly into openings in said side wall portions.

* * * * *